United States Patent [19]

McDonald et al.

[11] 4,175,673

[45] Nov. 27, 1979

[54] DISPENSING CARTON FOR CORRUGATED PLASTIC BAGS

[75] Inventors: James A. McDonald, Palos Heights; Mark C. Novak, Chicago, both of Ill.

[73] Assignee: Union Carbide Corporation, New York, N.Y.

[21] Appl. No.: 853,756

[22] Filed: Nov. 21, 1977

[51] Int. Cl.[2] ..... B65D 85/67

[52] U.S. Cl. ..... 221/63

[58] Field of Search ..... 221/33, 63, 34, 45, 221/46, 48, 56; 229/DIG. 13, 53; 206/526, 801

[56] References Cited

U.S. PATENT DOCUMENTS

| | | | |
|---|---|---|---|
| 3,765,565 | 10/1973 | Fietzer et al. | 221/59 |
| 4,044,919 | 8/1977 | Olson | 221/63 |

FOREIGN PATENT DOCUMENTS

| | | | |
|---|---|---|---|
| 1324512 | 7/1973 | United Kingdom | 221/63 |

*Primary Examiner*—Stanley H. Tollberg

*Attorney, Agent, or Firm*—Eugene Lieberstein

[57] ABSTRACT

A box-like dispensing carton in combination with a plurality of plastic bags arranged within the carton in a corrugated configuration. The carton has a removable access panel in one wall which provides an access aperture of compound geometry having one portion defined by an elongated opening and another portion by a narrow slot. The corrugated bags are arranged with each open end in tandem and in parallel with the wall having the access aperture and with the open end of each bag disposed closer to such wall than the closed end of each bag.

5 Claims, 5 Drawing Figures

DISPENSING CARTON FOR CORRUGATED PLASTIC BAGS

This invention relates to a combination dispenser package including a carton and a plurality of plastic bags folded in a corrugated configuration with the carton having a removable access panel for withdrawing said bags one at a time.

Paperboard cartons are conventionally used for the packaging and dispensing of bags made from plastic film. In order to accommodate plastic bags of large size within a small size carton it has been found advantageous to stack a plurality of such bags within the carton in a corrugated configuration. The conventional carton is provided with a removable access panel of generally oval geometry for exposing the corrugated folds of the bags upon removal of the panel. A bag is withdrawn from the conventional carton by grasping a fold and pulling it out of the access opening. An undesirable characteristic of this conventional carton dispenser package, containing a stack of corrugated bags, relates to the inability to control the dispensing of the bags so that only one bag is removable at a time. Another undesirable characteristic relates to the chance orientation of the mouth of a bag upon its removal from the carton.

The disadvantages of the prior art dispensing carton are overcome in accordance with the present invention by a combination of carton and bag arrangement which favors a different mechanical action for removal of a bag from the carton than previously practiced. The access aperture formed after removal of the access panel in the carton of the present invention has a geometry which invites a sliding motion to be initiated before the bags, appropriately positioned, can be withdrawn. This sliding motion assures that only one bag will be removed from the carton at one time.

Accordingly, it is the principal object of the present invention to provide, in combination, a dispensing carton having a removable access panel and a plurality of corrugated bags arranged within the carton in a predetermined fashion relative to the removable access panel so as to insure proper orientation of the mouth of the bag and also inhibit removal of more than one bag at a time from the carton.

Other objects and advantages of the present invention will become apparent from the following detailed description when read in conjunction with the accompanying drawings in which.

Figure 3:
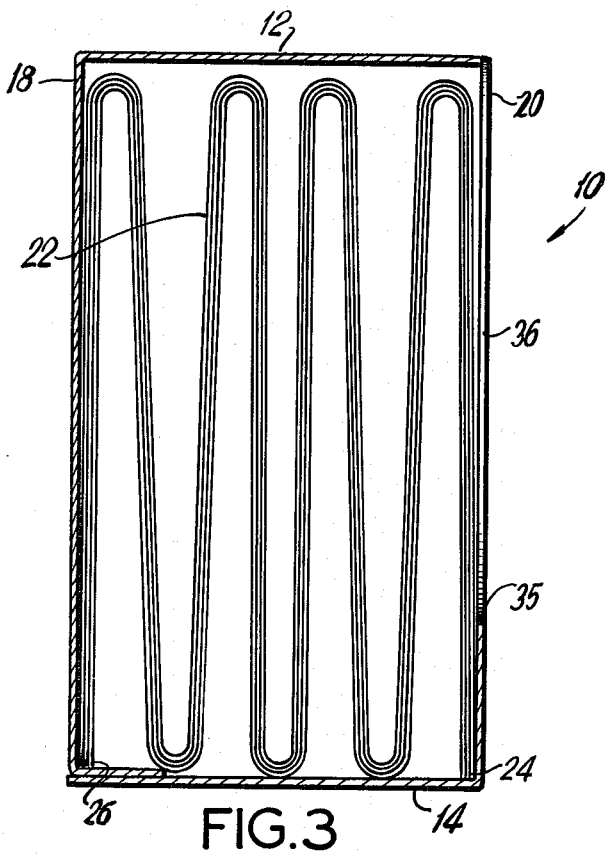
FIG. 3 is a cross-sectional view taken along the lines 3—3 of FIG. 2 showing one corrugated folding arrangement of bags within the carton.
Figure 5:
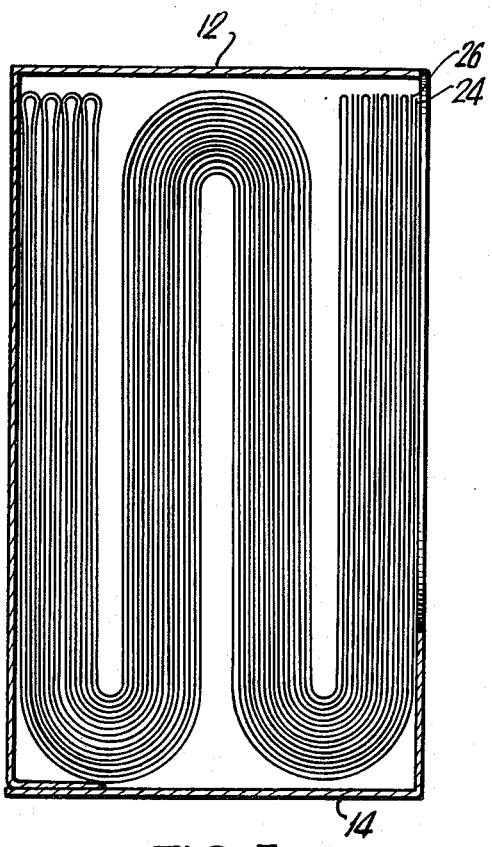
Figure 4:
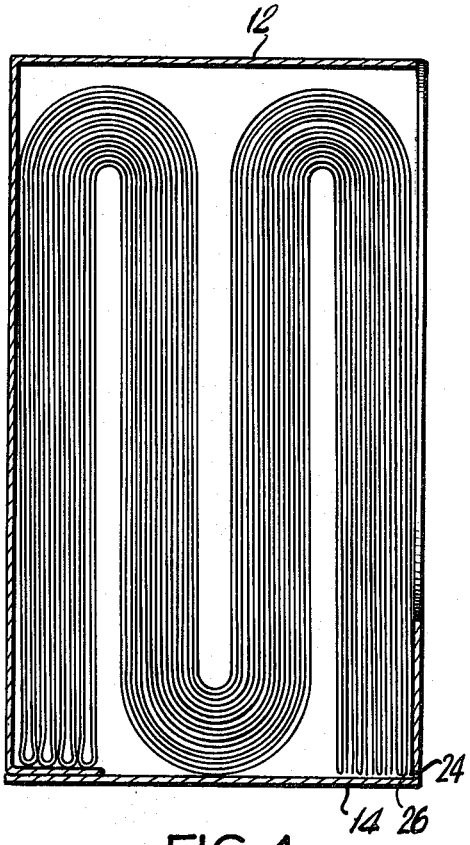

FIG. 4 is a cross-sectional view similar to FIG. 3 except that the bags were individually folded both in a longitudinal and transverse direction and then corrugated with the open and closed end of each of the bags disposed at the bottom of the carton; and FIG. 5 is a cross-sectional view similar to FIG. 4 with the corrugated folded bags placed into the carton so that the open and closed end of the bags lie adjacent the top of the carton.

Referring now to the drawings, FIGS. 1–5 inclusive, in which a box-like dispensing carton 10 is shown comprising a top wall 12, bottom wall 14, a pair of end walls, of which only one end wall 16 is visible, and side walls 18 and 20 respectively. The carton 10 may be composed of any suitably sturdy material, preferably paperboard, which is cut, folded and cemented to form, in a conventional manner, the preferred box-like geometry. The closing of one of the carton walls may be postponed until a plurality of plastic bags 22 have been inserted into the carton 10.

The bags 22 are stacked and arranged within the carton 10 in a corrugated configuration following conventional methods. A typical method for corrugating a stack of plastic bags for insertion within a carton is taught in U.S. Pat. No. 3,485,413. Another conventional method which discloses apparatus for loading and corrugating a stack of plastic bags within a carton is described in U.S. Pat. No. 3,919,827. A common technique is applied in both of the above cited patents for corrugating a plurality of plastic bags. The bags are arranged in a stack which is placed over a surface represented by at least one cylindrical mandrel. A plunger containing any desired number of dependent fingers is moved past the mandrel with the fingers positioned in an off-set relation thereto. This results in corrugating the stack of bags. The number of corrugations depend upon the number of fingers, the number of mandrels and the depth of the corrugations.

The plurality of bags 22 may be individually folded any given number of times before stacking. The folding of each of the bags 22 is usually necessary for very large size bags and may include one or more longitudinal folds or a combination of several longitudinal folds and one or more transverse folds. The direction and the number of folds controls the location of the open end 24 of each bag 22 relative to the location of the closed end 26 as will be explained in more detail hereafter with respect specifically to FIGS. 3, 4 and 5.

The size of the carton 10, and the relative dimensions of the walls are arbitrary and generally independent of the size of the bags 22. However, the open ends of the corrugated bags 22 must be properly aligned with respect to a removable access panel 30 formed as a tear out portion in the carton. The removable access panel 30 is located exclusively in only one wall of the carton 10, preferably the side wall 20 representing the front of the carton 10, so as to provide control over the dispensing procedure for withdrawing the bags 22 from the carton 10. A line of serrations 32 may be used to form the contour of the removable access panel 30. The geometry of the removable access panel 30 is critical to the present invention and includes two co-planar portions 31 and 34 which together form a compound curve. The first portion 31 of the access panel 30 forms, upon its removal, a narrow slot 33 having one side in common with the top edge 38 of the carton 10 and a second side 39. The second side 39 extends to substantially the opposite edges 40 and 42 of the carton 10. The narrow slot 33 leaves only a marginal space 43 and 44 at each opposite edge 40 and 42 respectively of the carton 10 so as not to weaken the structural integrity of the carton 10.

The second portion 34 of the access panel 30 has a somewhat flattened parabolic contour in the shape of a tongue with a substantially rounded bottom 35. The second portion 34 leaves a relatively elongated opening 36 upon removal of the access panel 30. The elongated opening 36 extends a distance, measured from the top edge 38 of the carton 10, equal to at least half of the smaller dimension of wall 20 but preferably not greater than about 90% of such dimension. The width "S" of the elongated opening 36 is an average measurement taken from a substantially intermediate point and is limited to a dimension substantially equal to no more than about the placement of a person's thumb lengthwise within the opening 36. The elongated opening 36 should preferably be located symmetrically about the center of the side wall 20 along its smaller dimension.

Figure 1:
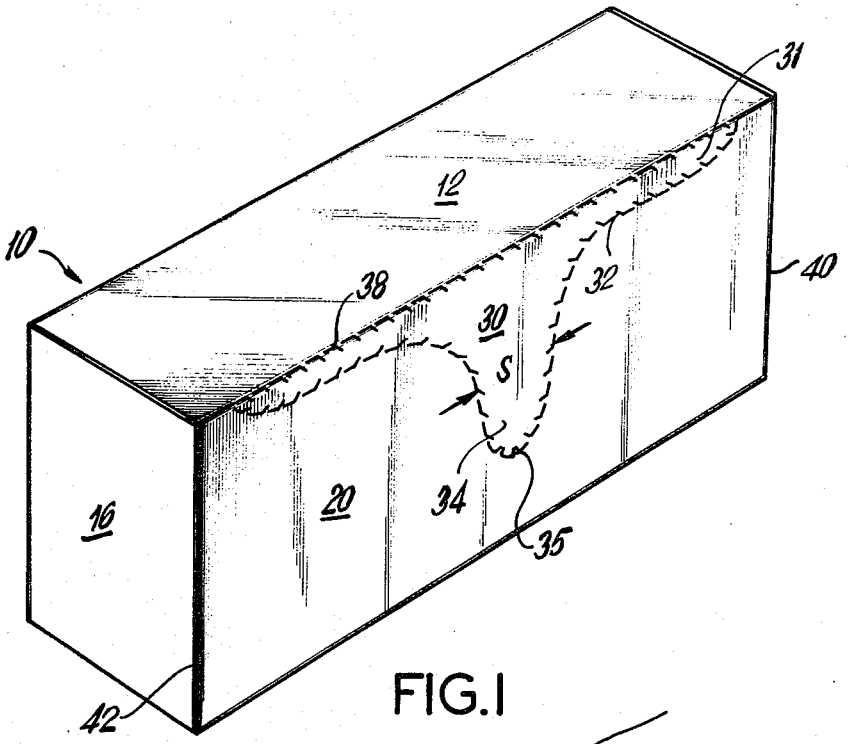
FIG. 1 is a perspective view of the carton of the present invention with the removable access panel shown on one side face thereof.
Figure 2:
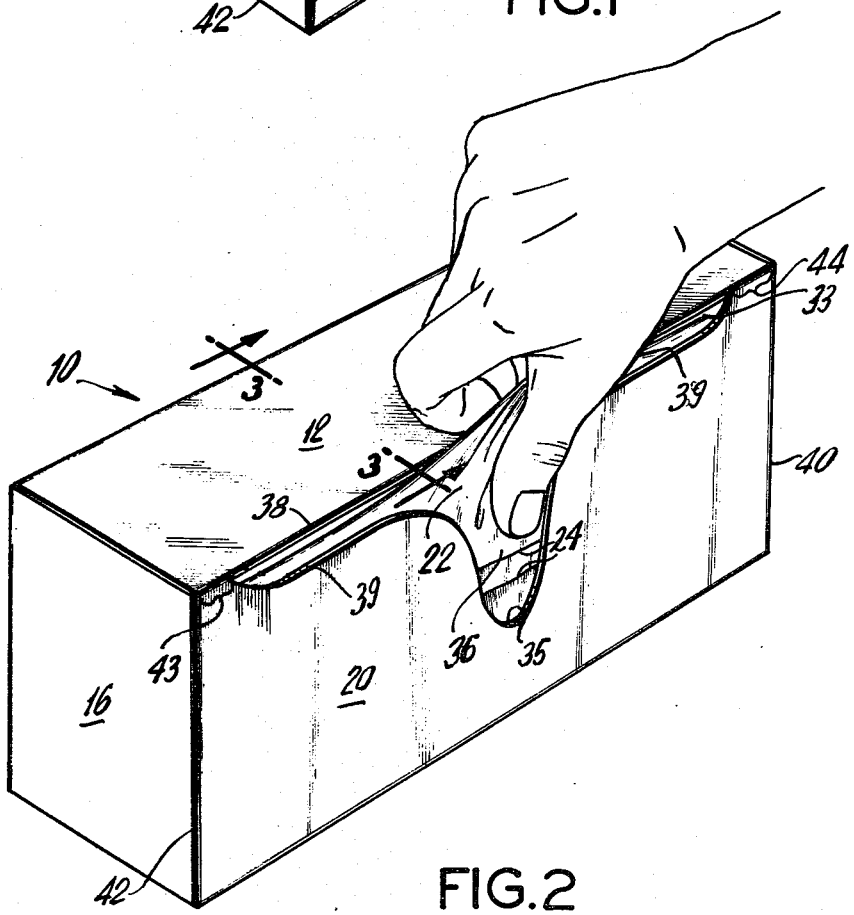
FIG. 2 is a perspective view similar to FIG. 1 with the removable access panel detached and with a bag in the process of being withdrawn from the carton.

The operation of withdrawing a bag 22 from the carton 10 is accomplished following the removal of the access panel 30 as is more clearly shown in FIG. 2. A finger, preferably the thumb, is placed within the opening 36 in contact against a bag 22. Because of the narrow width "S" of opening 36 it is first necessary to slide the thumb along the opening 36, preferably upwardly toward the top wall 12, in order to cause enough bunching up of the plastic bag 22 so that it can be readily grasped between the thumb and another finger such as the forefinger. This sliding motion assures that only one bag 22 at a time will be available for withdrawal from the carton 10.

The narrow slot 33 facilitates the withdrawal of a bag 22 by permitting the bag 22 to readily extend out from the carton 10 in response to the sliding motion. The space provided by the narrow slot 33 should not, however, be so large as to defeat the objective of the present invention in favoring the sliding operation as heretofore explained. A spacing equal to a thickness of ⅛–3/16 inches would be ample for this purpose.

The corrugated stack of bags 22 should be assembled within the carton 10 so as to lie with a flat planar surface facing the wall 20 and with the open end or mouth 24 of each bag 22 in tandem with respect to each other and parallel to the wall 20. By proper disposition of the corrugated stack of bags 22, so that the open or mouth end 24 of each bag always lies closer to the side wall 20 than the respective closed end 26, each extracted bag will have its open end 24 immediately available. As each bag 22 comes up for dispensing the open end 24 of the bag 22 is automatically accessible to the user.

In the corrugated arrangement shown in FIG. 3 the open end 24 of each bag 22 lies adjacent to one another at the bottom wall of the carton 10 while the closed end 26 of each bag lies adjacent to one another approximate the opposite side wall 18 of the carton 10. This arrangement was achieved by stacking all of the bags 22 with the open ends 24 adjacent to one another and with the closed ends 26 adjacent to one another before corrugating the bags. Each bag 22 was at the outset folded about its longitudinal axis before stacking. For simplicity in viewing the drawing each line represents at least several film thicknesses with each additional fold increasing the number of film thicknesses.

The arrangement shown in FIG. 4 is a variation of the corrugated arrangement of FIG. 3 and is accomplished by making several transverse folds in addition to and following the longitudinal folds before stacking the bags and corrugating them. The open end 24 of each bag 22 in this arrangement lies directly adjacent to its closed end 26 followed by an intermediate fold. This pattern of alternating open and closed ends repeats itself with the open ends in tandem relation to each other and to the access opening of the carton. Nonetheless, the open end 24 of each bag is still positioned closer to the side wall 20 than the closed end 26 of the same bag. FIG. 5 shows another arrangement of bags 22 folded and corrugated in the same fashion indicated in FIG. 4 but with the bags 22 packaged in an inverted position within the carton 10 so that the open end 24 and closed end 26 of each bag 22 faces the top wall 12 of the carton 10.

What is claimed is:

1. In combination, a box-like dispensing carton comprising, a top wall, a bottom wall, end walls and side walls, a single removable access panel located exclusively on one side wall of said carton, and a plurality of bags each having an open end and a closed end, said bags being arranged within the carton in a corrugated configuration with the open end of each bag lying in tandem parallel to said one side wall and being in closer proximity thereto than the closed end of each bag and with said removable access panel forming, upon its removal, a single aperture in the side of the carton for dispensing said bags one at a time, with said aperture having at least one portion defined by an elongated opening of a predetermined width located substantially about the center of said one side wall along its smaller dimension and having a width substantially limited in dimension to an average measurement based upon the placement of a person's thumb lengthwise within said opening and having a length extending a distance along said smaller dimension equal to at least one-half the width of said one side wall measured from the top edge of the carton.

2. The combination of claim 1 wherein said aperture further comprises another portion forming a narrow slot having one side in common with the edge of the carton between said one side wall and said top or bottom wall, said slot extending on opposite sides of said elongated opening.

3. The combination of claim 2 wherein said narrow slot terminates proximate the respective edges of said carton between said one wall and the end walls.

4. The combination of claim 1 wherein the open end of each bag lies adjacent to the bottom wall of said carton.

5. The combination of claim 1 wherein the open end of each bag lies adjacent to the top wall of said carton.

* * * * *